US007530687B2

(12) United States Patent
Ishii et al.

(10) Patent No.: US 7,530,687 B2
(45) Date of Patent: May 12, 2009

(54) MEDIUM TRANSPORTING DEVICE FOR RECORDING APPARATUS WITH SUCTION CHAMBERS

(75) Inventors: Takayuki Ishii, Nagano (JP); Yoshitaka Shimada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/793,698

(22) Filed: Mar. 5, 2004

(65) Prior Publication Data

US 2004/0239741 A1 Dec. 2, 2004

(30) Foreign Application Priority Data

Mar. 7, 2003 (JP) ..... P2003-062536
Mar. 7, 2003 (JP) ..... P2003-062537
Mar. 12, 2003 (JP) ..... P2003-066079

(51) Int. Cl.
*B65H 29/32* (2006.01)

(52) U.S. Cl. ..... 347/104; 271/196; 271/197

(58) Field of Classification Search ..... 347/104; 271/196, 197
See application file for complete search history.

(56) References Cited

U.S. PATENT DOCUMENTS 4,437,659 A * 3/1984 Caron et al. ..... 271/276
5,139,253 A * 8/1992 Bohme et al. ..... 271/197
5,197,812 A 3/1993 Worley et al.
5,874,979 A * 2/1999 Ohyama ..... 347/104
5,967,510 A * 10/1999 Ono et al. ..... 271/196
6,038,776 A * 3/2000 Yamada et al. ..... 33/18.1
6,092,894 A * 7/2000 Nuita et al. ..... 347/104
6,270,215 B1 8/2001 Miyasaka et al.
6,406,017 B1 * 6/2002 Yaneda ..... 271/276
6,497,522 B2 * 12/2002 Wotton et al. ..... 400/578
2002/0047885 A1 4/2002 Miyawaki et al.
2002/0126191 A1 * 9/2002 Fujioka ..... 347/104
2002/0167578 A1 11/2002 Miki et al.
2003/0085980 A1 * 5/2003 Ishii et al. ..... 347/104
2004/0169712 A1 * 9/2004 Tsuji ..... 347/104

FOREIGN PATENT DOCUMENTS

EP 1 223 042 A1 7/2002
JP 63-303781 A 12/1988
JP 3-270 A 1/1991
JP 9-220837 A 8/1997
JP 9-269619 A 10/1997
JP 2000-016637 A 1/2000
JP 2001-162870 A 6/2001
JP 2001-347710 A 12/2001
JP 2002-225358 A 8/2002

OTHER PUBLICATIONS

Patent Abstracts of Japan, vol. 013, No. 140 (M-810), Apr. 6, 1989.

* cited by examiner

*Primary Examiner*—Jill E. Culler
(74) *Attorney, Agent, or Firm*—Sughrue Mion, PLLC

(57) ABSTRACT

Of suction holes formed on a medium transporting surface, the areas of the suction holes formed in positions corresponding to ends of a medium which is being transported are set larger than the areas of other suction holes. Hereby, since large air flow is obtained under the both side ends or the leading end of the medium, the medium is transported in a state where the both side ends or the leading end are attracted into the suction holes, and a stain due to contact with a recording head can be prevented.

3 Claims, 12 Drawing Sheets

MEDIUM TRANSPORTING DEVICE FOR RECORDING APPARATUS WITH SUCTION CHAMBERS

The present application is based on Japanese Patent Applications Nos. 2003-62537, 2003-62536 and 2003-66079, the entire contents of which are incorporated herein by reference.

BACKGROUND OF THE INVENTION

The present invention relates to a medium transporting device which transports a medium and a recording apparatus provided with this medium transporting device.

Heretofore, for example, in an ink jet printer that is one of recording apparatuses, while paper that is one of recording media is being fed into a recording section by a paper transporting device, recording is performed and thereafter the paper is fed out to the outside. In such the ink jet printer, while the paper is fed in a state where it is held between a feed roller and its driven roller, recording is performed in a recording head, and thereafter the paper is fed out in a state where it is held by a discharge roller and a spur roller functioning as its driver roller, and discharged.

In the ink jet printer including such the paper transporting device, in case that an image composed of ejected many ink droplets, for example, a solid image is recorded on the paper, the paper absorbs a large amount of ink, so that it bulges toward the recording head in the wavy shape after recording, that is, cockling is produced. As this cockling develops, the distance between the paper and the recording head becomes more uneven, and unevenness is produced in ink splash distance, whereby unevenness is produced in recording, or the paper comes into contact with the recording head and stains. Therefore, recently, an ink jet printer has been proposed, in which plural openings are formed on a paper transporting surface in the paper transporting direction and in the direction perpendicular to the paper transporting direction at a regular pitch, that is, the plural openings are provided in the shape of a grid, and the paper is sucked through these opening by a suction pump thereby to suppress the above cockling (refer to JP-A-63-303781 and JP-A-3-270).

Generally, a curve (curl) is produced in paper by the influence of environment such as humidity and temperature, or by properties of surface coat material. Particularly, it is most difficult to suck and attract ends (a leading end and both side ends) of the paper which has curled upward. Therefore, there is fear that the ends of the paper which has curled are stained by contact with the recording head.

Further, by setting of a position of a feed roller arranged in a paper transportation-insertion part of the above paper transporting device, it is possible to press the leading end of the inserted paper on the paper transporting surface thereby to prevent coming-up of the leading end. However, as the paper advances, the power for pressing mechanically the leading end of the paper on the paper transporting surface is reduced, so that the leading end of the paper readily separates from the paper transporting surface. Therefore, there is fear that the leading end of the paper which has come up is stained by the contact with the recording head.

In the ink jet printers including the above conventional suction type paper transporting device, there is an ink jet printer having a dimple around each opening in order to heighten suction force determined by negative pressure×area. However, since the dimples are formed in the shape of a grid correspondingly to each opening, both ends of the paper in a direction perpendicular to the paper transporting direction, that is, both side ends of the paper get on partition walls formed outside the dimples corresponding to the both side ends of the paper. Therefore, the both side ends of the paper readily curl up by the suction force of holes in the dimples corresponding to the both side ends, and there is fear that the both side ends are stained by contact with the recording head.

SUMMARY OF THE INVENTION

An object of the invention is to prevent curling-up and coming-up of the ends of the medium when the medium is transported.

In order to achieve the object, according to the first aspect of the invention, a medium transporting device comprising: a medium transporting surface having a plurality of suction holes on which a supplied medium is transported; wherein an area of the suction hole formed in a position at which an end of said medium which is transported is set larger than that of other suction holes formed on said medium transporting surface.

Further, a medium transporting device according to the second aspect of the invention is characterized in that each area of the suction holes formed in positions at which both side ends of said medium are transported is set larger than that of other suction holes. Hereby, since the amount of air flowing below the both side ends of the medium becomes large, the medium is transported in a state where its both side ends are attracted into the suction holes, so that it is possible to prevent the both side ends of the medium from being stained by contact with the recording head.

Further, a medium transporting device according to the third aspect of the invention is characterized in that an area ratio of said suction hole having a larger area with respect to said suction hole having a smaller area is 2 to 6.5. Hereby, it is possible to make large the amount of air flowing below the both side ends of the medium without reducing the suction force.

Further, a medium transporting device according to the fourth aspect of the invention is characterized in that an area of the suction hole on a transportation downstream side on said medium transporting surface is larger than an area of the suction hole on a transportation upstream side. Hereby, since the amount of air flowing below the leading end of the medium becomes large, the medium is transported in a state where its leading end is attracted into the suction holes, so that it is possible to prevent the leading end of the medium from being stained by the contact with the recording head, Further, a medium transporting device according to the fifth aspect of the invention is characterized in that said suction holes are formed so that the areas become larger toward the transportation downstream side. Hereby, it is possible to make large the amount of air flowing below the leading end of the medium without reducing the suction force.

A medium transporting device according to the sixth aspect of the invention, comprising: a medium transporting surface having a plurality of suction holes on which a supplied medium is transported; wherein portions on said medium transporting surface at which both side ends of said medium pass are provided so that both side edges of said medium come downwards. Hereby, after the both side ends of the medium have come down, the medium is transported in this state. Therefore, unlike the related art, it is prevented that both side ends of the medium get on the partition walls formed outside the dimples (suction chambers) corresponding to the both side ends of the medium, and it is prevented that the both side ends of the paper curl up by the suction force of the holes (suction holes) in the dimples corresponding to the both side ends, so that it is possible to prevent the both side ends of the medium from being stained by contact with the recording head.

Further, a medium transporting device according to the seventh aspect on the invention is characterized in that said portions on the medium transporting surface are formed stepwise. Further, a medium transporting device according to the eighth aspect of the invention is characterized in that said portions on said medium transporting surface are formed aslant. Hereby, the both side ends of the medium can come down surely. Further, a medium transporting device according to the ninth aspect of the invention is characterized in that said portions on the medium transporting surface are formed in a plural number correspondingly to predetermined sizes of said medium. Hereby, it is possible to prevent the medium of each size from being stained by the contact with the recording head. Further, a medium transporting device according to the tenth aspect of the invention is characterized in that said portions on the medium transporting surface have recording material receiving members. Hereby, so-called frameless recording can be performed.

In order to achieve the above object, a liquid jet apparatus according to the eleventh aspect of the invention is characterized by including a jetted material transporting device having the above each function of the medium transporting device according to any one of the first to tenth aspects. Hereby, it is possible to provide the liquid jet apparatus taking the above each working effect.

In order to achieve the above object, a recording apparatus including the medium transporting device according to the twelfth aspect of the invention is characterized by including the medium transporting device according to any one of the first to eleventh aspects. Hereby, it is possible to provide the recording apparatus taking the above each working effect.

DESCRIPTION OF THE PREFERRED EMBODIMENTS

Embodiments of the invention will be described below with reference to drawings.

Figure 1:
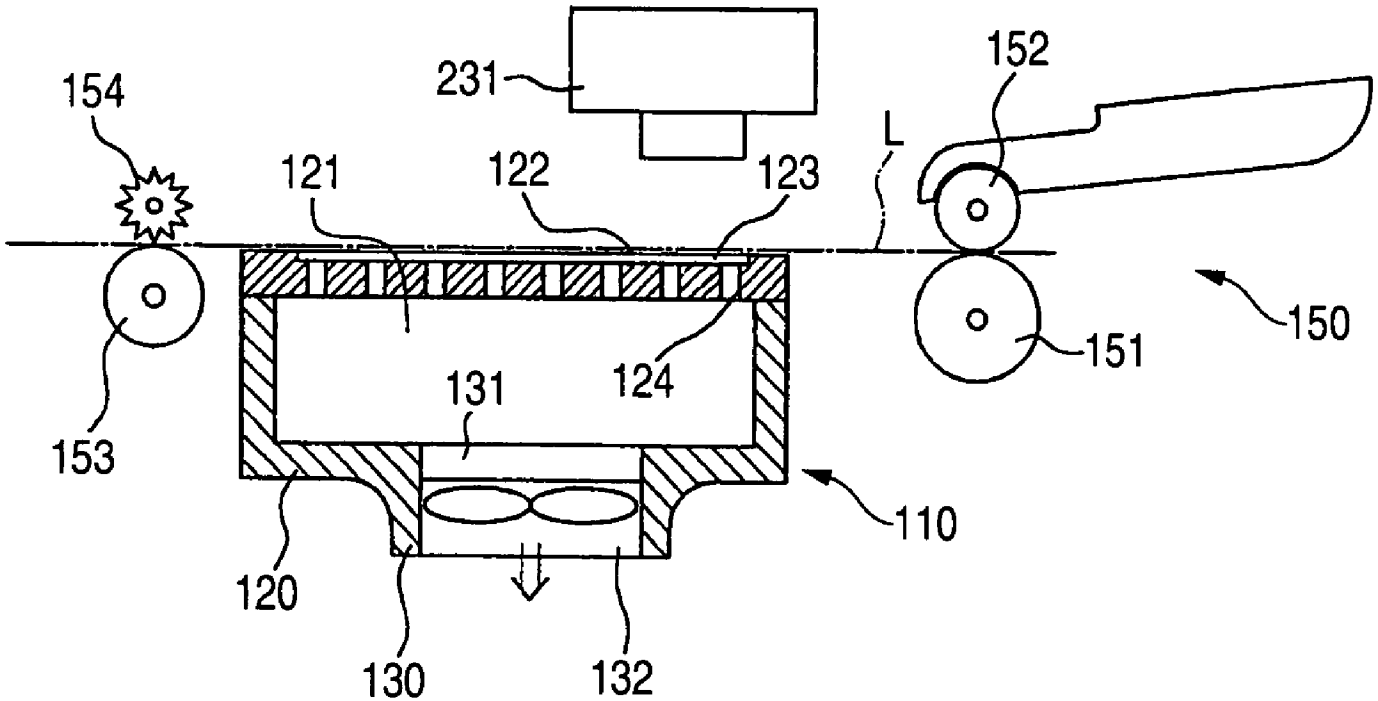
FIG. 1 is a side view showing a medium transporting device according to an embodiment of the invention.

FIG. 1 is a side view showing a recording medium transporting device that is one of medium transporting devices according to an embodiment of the invention. This recording medium transporting device 100 includes a suction unit 110 which sucks and holds a recording medium at the recording time, and a recording medium transporting unit 150 which transports the recording medium from the upstream side of the suction unit 110 to the downstream. The suction unit 110 is arranged below a recording head 231 for recording data on the recording medium, forming a recording medium transporting path L therebetween. Further, the suction unit 110 is formed in the shape of a hollow box having up-and-down two-stage structure comprising a suction part 120 of the upper stage and a suction force generating-part 130 of the lower stage.

A first embodiment of the suction part 120 will be described. The suction part 120 comprises a pressure reduction chamber 121 formed inside, plural suction chambers 123 which are formed on a recording medium transporting surface 122 in the shape of a rectangular recess that is long in the transporting direction of the recording medium, and plural suction holes 124 which have circular and smaller cross-section than the suction chambers 123 extending up and down so as to communicate these suction chambers 123 respectively with the pressure reduction chamber 121.

The suction force generating part 130 is communicated with the pressure reduction chamber 121 of the suction part 120 through a communication hole 131, and includes a pump 132 having a centrifugal fan inside. The pump 132 is attached in the predetermined position below the pressure reduction chamber 121 in a state where it communicates with the pressure reduction chamber 121 through the communication hole 131, and the centrifugal fan turns at the recording time.

The recording medium transporting unit 150 comprising a feed roller 151 which feeds the recording medium between the recording head 231 and the suction unit 110, a driven roller 152 which is brought into pressure-contact with this feed roller 151 from the upside, a discharge roller 153 which discharges the recording medium to the outside, and a spur roller 154 which is brought into contact with this discharge roller 153 from the upside. In case of the constitution in which the suction unit 110 can be moved in the discharge direction, the discharge roller 153 and the spur roller 154 may not be provided.

Figure 2A:
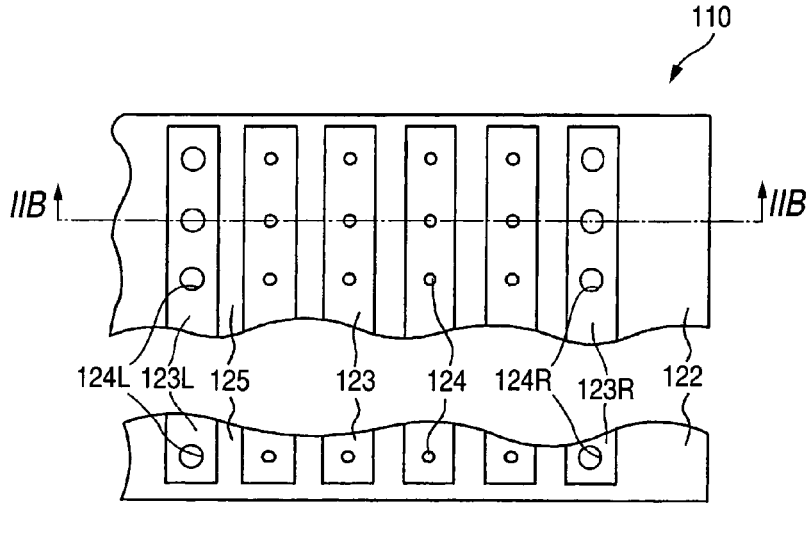
FIGS. 2A is a plan view and FIG. 2B is a sectional side view taken along a line IIB-IIB of FIG. 2A, which show a first embodiment of a suction part in FIG. 1.
Figure 2B:
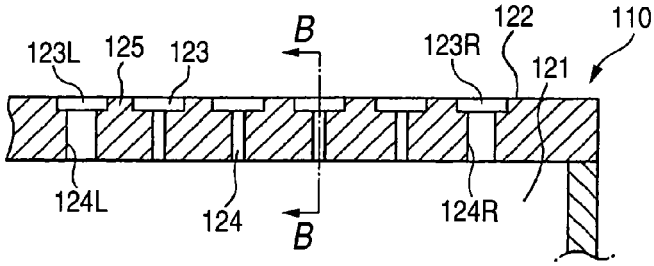

FIGS. 2A and 2B are plan view of the suction part 120 in the first embodiment and a sectional side view taken along a line IIB-IIB of FIG. 2A. The suction chamber 123 is formed so that its short side has the predetermined length and its long side has the length leading from the neighborhood of an upstream end of the recording medium transporting surface 122 to the neighborhood of a downstream end. Namely, each suction chamber 123 extends in the transporting direction of the recording medium in succession, and the suction chambers 123 are arranged in the direction perpendicular to the transporting direction of the recording medium with a partition wall therebetween.

The suction holes 124 are formed on the bottom surface of the suction chamber 123 in the transporting direction of the recording medium at the predetermined pitch. Namely, the suction holes 124 are formed for each suction chamber 123 in a row. Further, as a characteristic part of the invention, suction holes 124R and 124L formed in suction chambers 123R and 123L on which both ends of the recording medium in the direction perpendicular to the transporting direction of the recording medium, that is, both side ends of the recording medium pass are formed so that their areas become larger than those of other suction holes 124.

Under a state where the recording medium is stuck onto the recording medium transporting surface 122 by suction, the air flow is not produced below the recording medium. The magnitude of negative pressure (static pressure) in the pressure reduction chamber 121 is dominant over power for keeping this state (suction force in the close attachment state). On the other hand, under a state where the recording medium separates from the recording medium transporting surface 122, the air flow is produced below the recording medium. By dynamic pressure loss caused by air flow between the lower surface of the recording medium and the recording medium transporting surface 122, the recording medium is attracted on the recording medium transporting surface 122.

In the invention, using this latter working, the both side ends of the recording medium curled upward are sucked and attracted onto the recording medium transporting surface 122. The larger the amount of air flowing below the recording medium is, the greater an effect is. This large amount of air flow is obtained by making the area of the suction hole 124 large. However, in case that the areas of all the suction holes 124 are made large, the negative pressure in the pressure reduction chamber 121 becomes small because of the following reason, so that the suction force decreases. Namely, by the gross area of the suction holes 124 and the flow rate characteristics of the pump 132, the negative pressure in the pressure reduction chamber 121 is determined.

Figure 3:
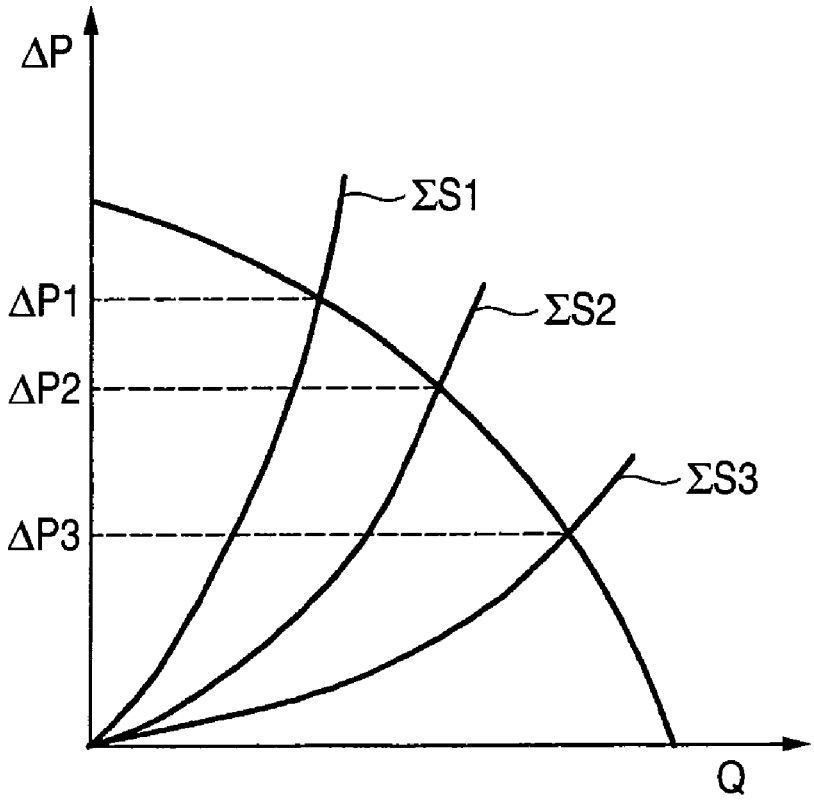
FIG. 3 is a diagram showing a relation among negative pressure in a pressure reduction chamber, the gross area of suction holes and flow rate of a pump, and characteristics of the negative pressure in the pressure reduction chamber and the pump flow rate.

FIG. 3 is a diagram showing a relation among a negative pressure ΔP in the pressure reduction chamber 121, the gross area ΣS of the suction holes 124 and a flow rate Q of the pump 132, and characteristics of the negative pressure ΔP in the pressure reduction chamber 121 and the flow rate of the pump 132. The negative pressure ΔP in the pressure reduction chamber 121 is represented by the following expression (1), on the basis of the gross area ΣS of the suction holes 124 and the flow rate Q of the pump 132.

$$\Delta P=\rho(Q/\Sigma S)^2/2 \quad (1)$$

Accordingly, an intersection of a graph of the expression (1) and a characteristic graph becomes the negative pressure ΔP in the pressure reduction chamber 121 determined by the suction holes 124 of the gross area ΣS at that time. For example, the negative pressure in the pressure reduction chamber 121 determined when the suction holes 124 of the gross area ΣS1 are formed becomes ΔP1, the negative pressure in the pressure reduction chamber 121 determined when the suction holes 124 of the gross area ΣS2 that is larger than the gross area ΣS1 are formed becomes ΔP2 that is smaller than the negative pressure ΔP1, and the negative pressure in the pressure reduction chamber 121 determined when the suction holes 124 of the gross area ΣS3 that is larger than the gross area ΣS2 are formed becomes ΔP3 that is smaller than the negative pressure ΔP2. Namely, as the gross area ΣS of the suction holes 12 increases, the negative pressure ΔP in the pressure reduction chamber 121, that is, the suction force decreases. Therefore, in this case, it is important to make larger only the suction holes 124R and 124L formed in the most necessary portions through which the both side ends of the recording medium pass than other suction holes 124.

Hereby, since the gross area of the suction holes 124 can be made small, the negative pressure in the pressure reduction chamber 121 can be made large. Therefore, it is possible to dynamically suck the recording medium of which both side ends curl upward, and particularly the recording medium that is high in rigidity and to attract it readily. Here, it is preferable that the area ratio of the suction holes 124R and 124L formed in the portions through which both side ends of the recording medium pass to the other suction holes 124 is 2 to 6.5. For example, when the suction holes 124R and 124L formed in the portions through which both side ends of the recording medium pass are formed with the area ϕ5, the other suction holes 124 are formed with the area ϕ3.5 to ϕ2.

As described above, the suction opening is composed of the suction holes 124 and the suction chamber 123, and further the suction hole 124 is formed into the through-hole having the small diameter, whereby coefficient of utilization of the negative pressure which can be utilized in relation to the characteristic of the pump 132 is heightened. Further, the suction chamber 123 is formed as the nearly rectangular recess that is larger in area than the suction hole 124, whereby the great suction force can be generated in relation to the recording medium. Further, the suction holes are formed so that the suction holes 124R and 124L formed in the suction chambers 123R and 123L of the portions on which both side ends of the recording medium pass are larger in area than the other suction holes 124. Therefore, the both side ends of the recording medium are kept attracted into the suction holes 124R and 124L and transported. Accordingly, since it is prevented that the both side ends of the medium are curled up unlike the related art, it is possible to prevent the stain on the medium caused by contact with the recording head 231.

The thus constructed recording medium transporting device 100 operates as follows: The feed roller 151 rotates and feeds the recording medium between the recording head 231 and the suction unit 110. On the other hand, the pump 132 operates and applies the suction force through the communication hole 131 and the pressure reduction chamber 121 to the suction hole 124 and the suction chamber 123. Hereby, the recording medium is transported in a state where it is sucked on the recording medium transporting surface 122. Simultaneously, the recording head 231, moving in a main scanning direction above the recording medium, ejects an ink droplet on the recording medium to perform recording.

At this time, the both side ends of the recording medium are kept attracted into the suction holes 124R and 124L and transported. Therefore, it is possible to prevent the recording medium from being stained by the contact with the recording head 231 caused by curling-up of the both side ends of the recording medium. Next, the discharge roller 153 rotates and discharges the recording medium on which recording has been completed to the outside.

Figure 4:
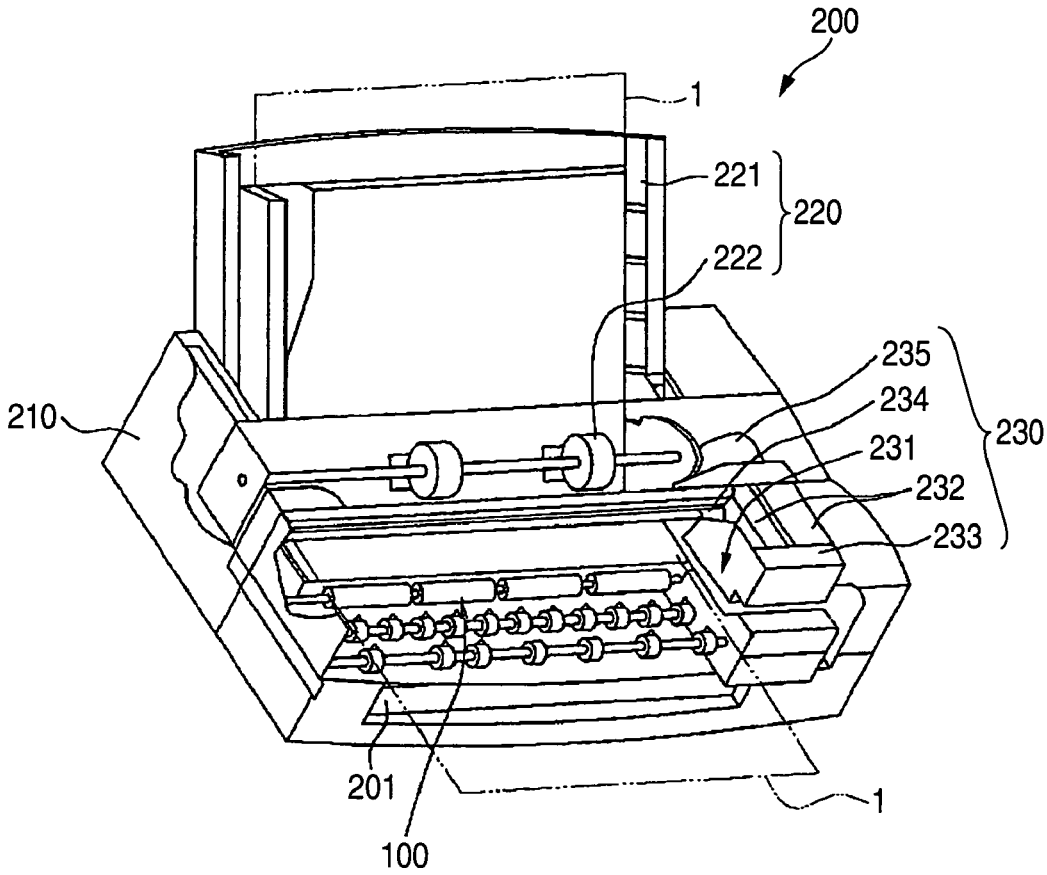
FIG. 4 is a perspective view showing an ink jet printer as a recording apparatus provided with the medium transporting device of the invention.
Figure 5:
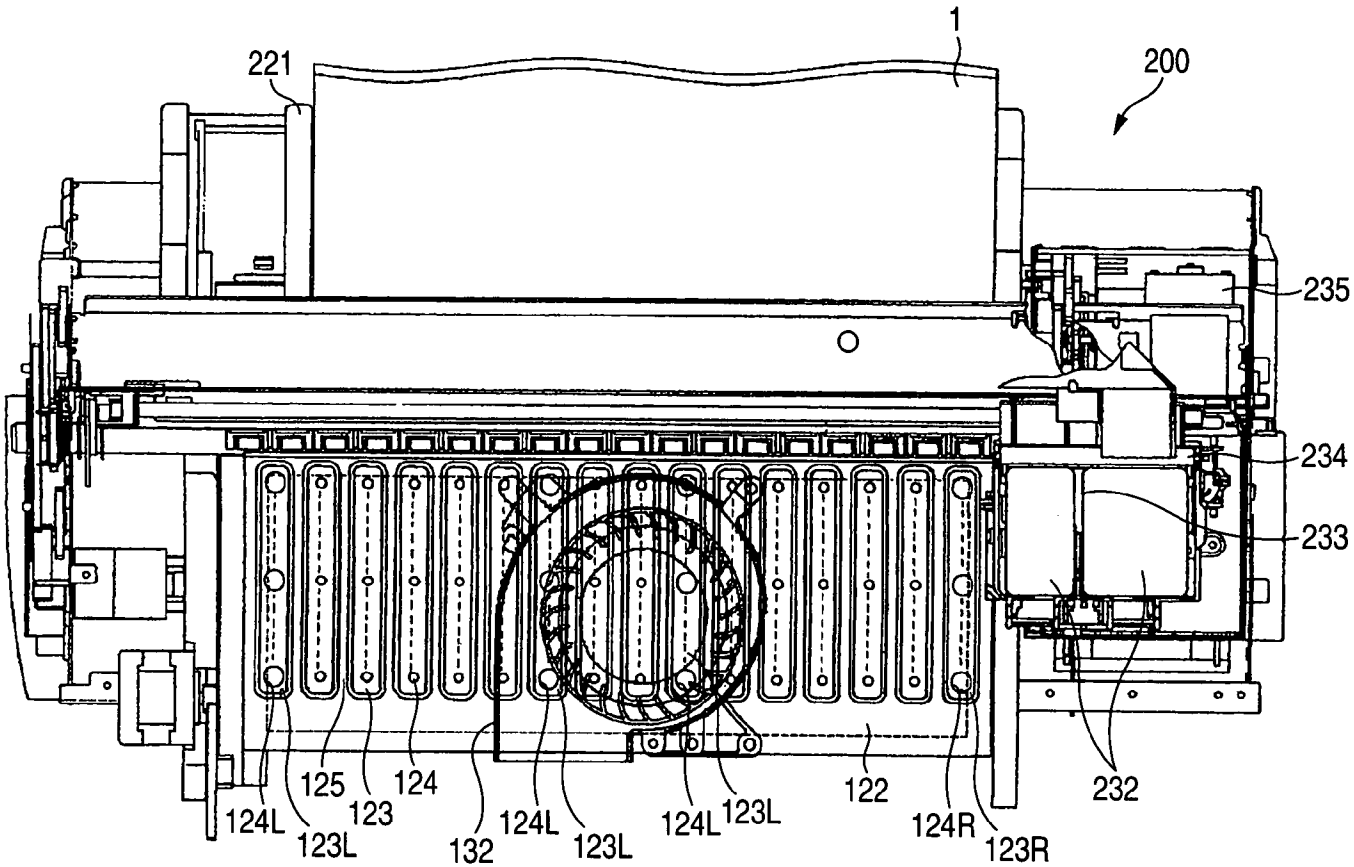
FIG. 5 is a plan view showing a main part according to the first embodiment of the ink jet printer in FIG. 4.
Figure 6:
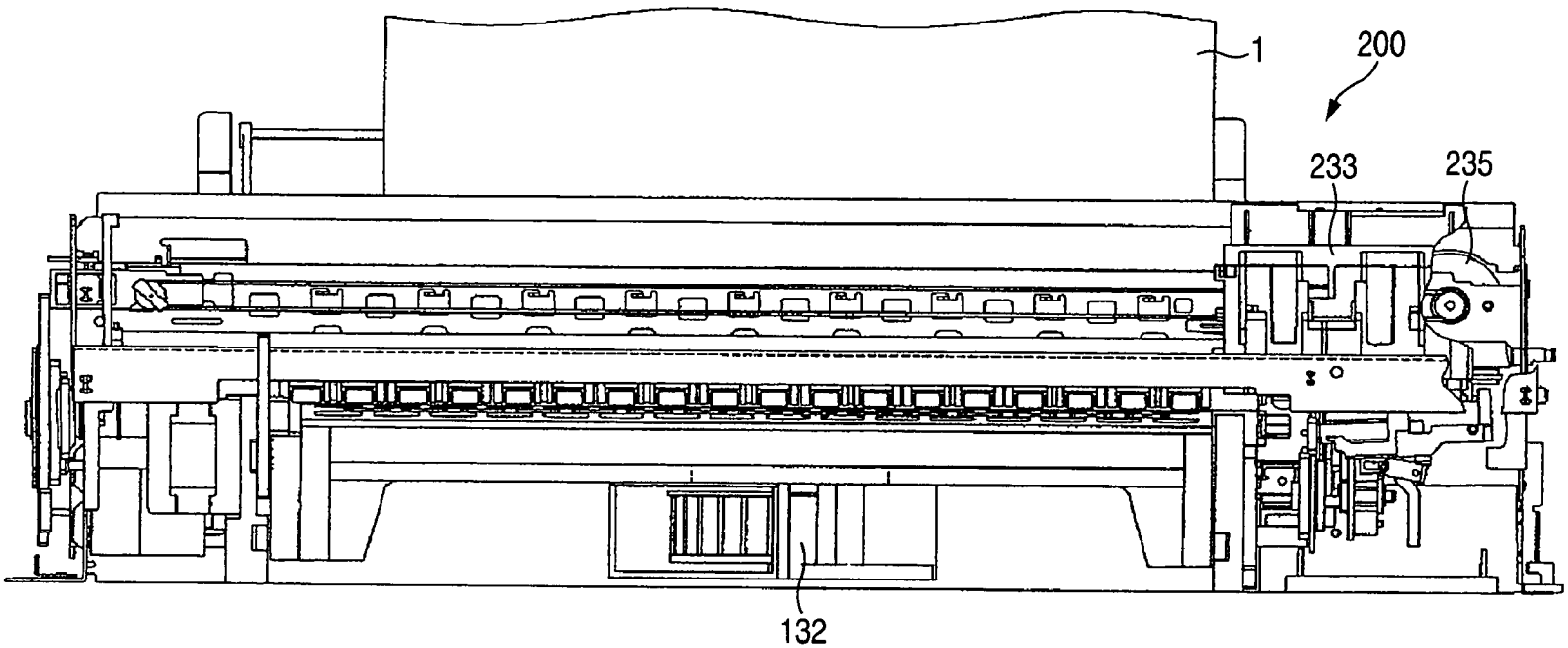
FIG. 6 is a front view showing the main part of the ink jet printer in FIG. 4.
Figure 7:
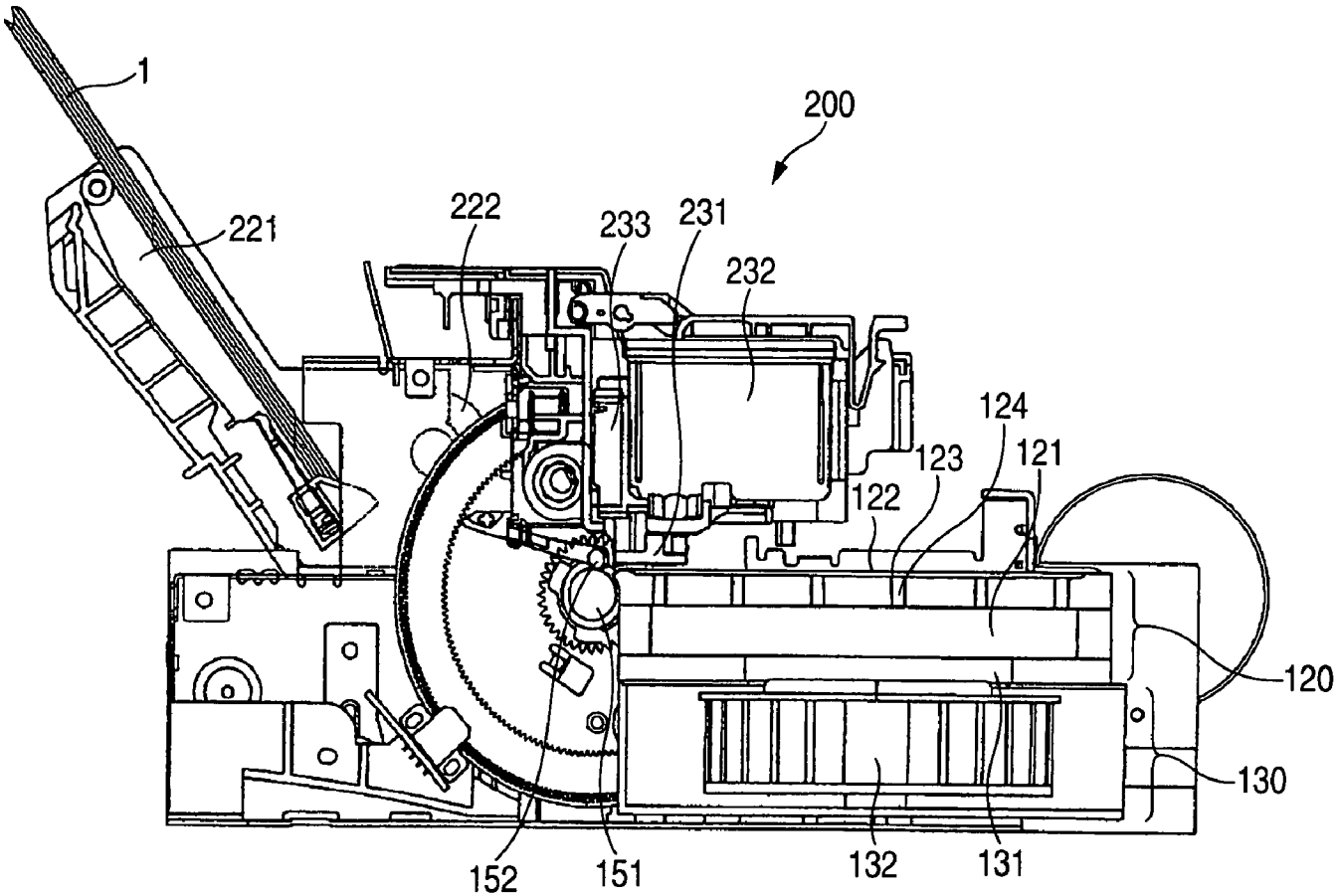
FIG. 7 is a side view showing the main part of the ink jet printer in FIG. 4.

FIG. 4 is a perspective view of an ink jet printer as a recording apparatus provided with the above recording medium transporting device 100, and FIGS. 5 to 7 are a plan view, a front view, and a side view which show a main part of the ink jet printer. This ink jet printer 200 comprises an automatic supply feeding (ASF) unit 220 aslant attached to the backward upper portion of a printer body 210, a recording part 230 included in the printer body 210, and the recording medium transporting device 100. As a recording medium, paper for the ink jet printer 200, plain paper, an OHP film, tracing paper, and a post cart can be used.

The ASF unit 220 comprises a tray 221 in which paper 1 is housed, and a supply roller 222 which pulls out the paper 1 from this tray 221 and supplies it. The recording part 230 comprises a carriage 233 on which a recording head 231 and an ink cartridge 232 are mounted, and a DC motor 235 which moves this carriage 233 along a guide shaft 234 arranged in the main scanning direction. The recording head 231 has a nozzle array comprising plural nozzles, for example, ninety-six nozzles for each color of cyan, magenta, yellow, light cyan, light magenta, dark yellow, and black.

The recording medium transporting device 100 includes the suction unit 110 comprising the suction part 120 of the upper stage which sucks and holds the recording medium at the recording time and the suction force generating part 130 of the lower stage, and the recording medium transporting unit 150 which transports the recording medium from the upstream side of the suction unit 110 to the downstream. The suction part 120 comprises the pressure reduction chamber 121 formed inside, the plural suction chambers 123 which are formed on the recording medium transporting surface 122 in the shape of a rectangular recess that is long in the transporting direction of the recording medium, and the plural suction holes 124 which communicate these suction chambers 123 respectively with the pressure reduction chamber 121.

The suction holes 124R and 124L formed in the suction chambers 123R and 123L of the portions on the recording medium transporting surface 122 through which both ends of the recording medium in the direction perpendicular to the transporting direction of the recording medium, that is, both side ends of the recording medium pass are formed so that their areas become larger than those of the other suction holes 124. These suction holes 124R and 124L, correspondingly to each size of the recording medium, for example, B5 size, A4 size, B4 size and A3 size by JIS, are formed, and the number of them is plural. Hereby, it is possible to prevent the stain on the medium of each size caused by contact with the recording head 231.

As described foregoing, the recording medium transporting unit 150 includes the feed roller 151 which feeds the recording medium between the recording head 231 and the suction unit 110, and the driven roller 152 which is brought into pressure-contact with this feed roller 151 from the upside. This ink jet printer 200 has the suction unit 110 which can move in the discharge direction and is not provided with the discharge roller 153 which discharges the recording medium to the outside and the spur roller 154 brought into contact with the discharge roller 153 from the upside as shown in FIG. 1. However, the ink jet printer having the discharge roller 153 and the spur roller 154 may be used.

The thus constructed ink jet printer 200 operates as follows. When a recording instruction on the paper 1 housed in the tray 221 is input from a not-shown host computer, the supply roller 222 rotates and picks up the paper housed in the tray 221 one by one to supply it. Further, the feed roller 152 rotates and feeds the paper 1 between the recording head 231 and the suction unit 110.

On the other hand, the pump 132 operates, and applies the suction force through the communication hole 131 and the pressure reduction chamber 121 to the suction hole 124 and the suction chamber 123. Hereby, the paper 1 is transported in the state where it is sucked on the recording medium transporting surface 122. Simultaneously, the DC motor operates, and moves the carriage 233 through a timing belt along the guide shaft 234. At this time, the recording head 231 ejects ink of each color supplied from the ink cartridge 232 as a minute ink droplet on the paper 1 from all or a part of the plural nozzles according to recording data thereby to record the data. Since the both side ends of the recording medium, kept attracted into the suction holes 124R and 124L, are transported, it is possible to prevent the recording medium from being stained by the contact with the recording head 231 caused by curling-up of the both side ends of the recording medium. Next, the discharge roller 153 rotates and discharges the paper 1 on which recording has been completed from a discharge outlet 201 to the outside.

As described above, since the both side ends of the recording medium, kept attracted into the suction holes 124R and 124L, are transported, it is possible to bring the recording head 231 nearer to the recording medium, and recording accuracy can be further improved. In the first embodiment, though the suction chamber 123 is formed into the rectangular recess that is long in the transporting direction of the recording medium, also in case that it is formed in the shape of grid like the related art, the similar effect can be obtained. Further, also in case that a suction unit which has only the suction hole 124 without having the suction chamber 123 is used, the similar effect can be obtained.

Next, a second embodiment of the suction part 120 will be described.

Figure 8A:
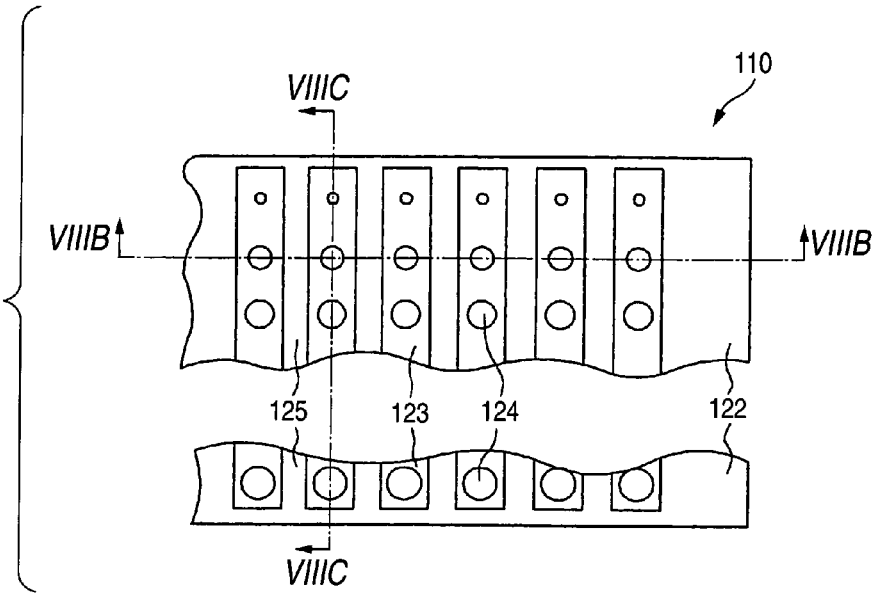
FIGS. 8A to 8C are a plan view, a sectional side view taken along a line VIIIB-VIIIB of FIG. 8A, and a sectional side view taken along a line VIIIC-VIIIC of FIG. 8A, which show a second embodiment of the suction part in FIG. 1.
Figure 8B:
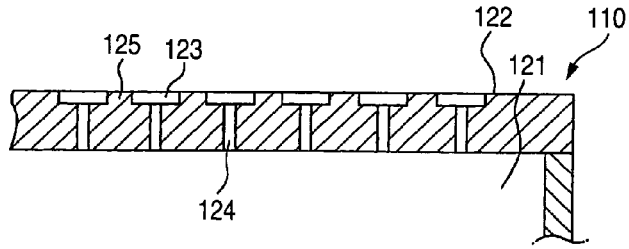
Figure 8C:
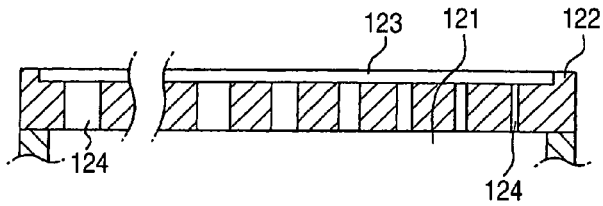

FIGS. 8A, 8B and 8C are a plan view, a sectional side view taken along a line VIIIB-VIIIB of FIG. 8A, and a sectional side view taken along a line VIIIC-VIIIC of FIG. 8A, which show a second embodiment of the suction part. The same components as those in the first embodiment are denoted by the same reference numerals. A suction chamber 123 is formed so that its short side has the predetermined length and its long side has the length leading from the neighborhood of an upstream end of the recording medium transporting surface 122 to the neighborhood of a downstream end. Namely, each suction chamber 123 extends in the transporting direction of the recording medium in succession, and in the direction perpendicular to the transporting direction of the recording medium, the suction chambers 123 are arranged with a partition wall 125 between.

As the characteristics of the embodiment, on the transportation downstream side of the recording medium, the suction hole 124 having which is larger in area is formed. Specifically, the suction holes 124 are formed so that their areas increase toward the transportation downstream side of the recording medium.

Under a state where the recording medium is stuck onto the recording medium transporting surface 122 by suction, the air flow is not produced below the recording medium. The magnitude of negative pressure (static pressure) in the pressure reduction chamber 121 is dominant over power for keeping this state (suction force in the close attachment state). On the other hand, under a state where the recording medium separates from the recording medium transporting surface 122, the air flow is produced below the recording medium. By dynamic pressure loss caused by air flow between the lower surface of the recording medium and the recording medium transporting surface 122, the recording medium is attracted on the recording medium transporting surface 122.

In the invention, as described above, the larger the amount of air flowing below the recording medium is, the greater an effect is. This large amount of air flow is obtained by making the area of the suction hole 124 large.

However, in case that the areas of all the suction holes 124 are made large, the negative pressure in a pressure reduction chamber 121 becomes small as described above, whereby the suction force decreases. Therefore, in this embodiment, the areas of the suction holes toward the transportation downstream of the recording medium are increased. Hereby, since the gross area of the suction holes 124 can be made small, the negative pressure in the pressure reduction chamber 121 can be made large. Therefore, it is possible to dynamically suck the recording medium of which leading end curls upward, and particularly the recording medium that is high in rigidity and to attract it readily.

As described above, the suction opening is composed of the suction hole 124 and the suction chamber 123, and further the suction hole 124 is formed into the through-hole having the small diameter, whereby coefficient of utilization of the negative pressure which can be utilized in relation to the characteristic of the pump 132 is heightened. Further, the suction chamber 123 is formed as the nearly rectangular recess that is larger in area than the suction hole 124, whereby the great suction force can be generated in relation to the recording medium. Further, the areas of the suction holes 124 increase toward the transportation downstream side of the recording medium. Therefore, the leading end of the recording medium is, even in case that the recording medium advance, kept attracted into the suction holes 124 and transported. Accordingly, unlike the related art, it is possible to prevent the stain on the medium by contact with the recording head 231 caused by coming-up of the leading end of the recording medium.

The thus constructed recording medium transporting device 100 operates as follows: Similarly to the first embodiment, the feed roller 151 rotates and feeds the recording medium between the recording head 231 and the suction unit 110. On the other hand, the pump 132 operates and applies the suction force through the communication hole 131 and the pressure reduction chamber 121 to the suction hole 124 and the suction chamber 123. Hereby, the recording medium is transported in a state where it is sucked on the recording medium transporting surface 122. Simultaneously, the recording head 231, moving in a main scanning direction above the recording medium, ejects an ink droplet on the recording medium to perform recording.

In this embodiment, the leading end of the recording medium is, kept attracted into the suction holes 124, transported. Therefore, it is possible to prevent the recording medium from being stained by the contact with the recording head 231 caused by coming-up of the leading end of the recording medium. Next, the discharge roller 153 rotates and discharges the recording medium on which recording has been completed to the outside.

Figure 9:
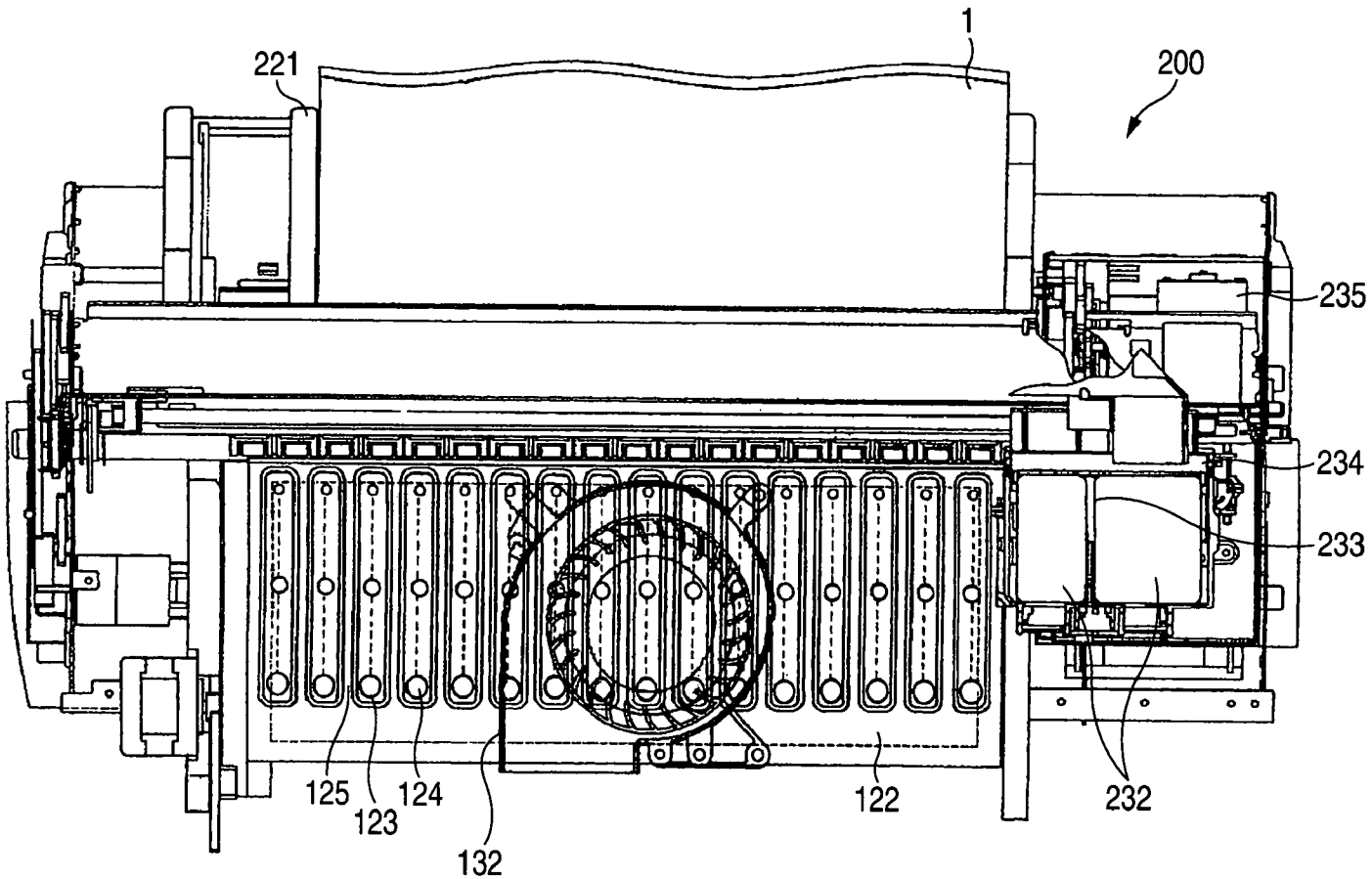
FIG. 9 is a plan view showing a main part according to the second embodiment of the ink jet printer in FIG. 4.

FIG. 9 is a plan view showing a main portion of an ink jet printer having the suction part 120 in the second embodiment, in which the same components as those in FIG. 5 are denoted by the same reference numerals. The suction holes 124 are formed throughout the entire surface of the recording medium transporting surface 122 so that their areas gradually increase toward the transportation downstream side of the recording medium. Hereby, it is possible to prevent the recording medium of each size from being stained by the contact with the recording head 231. The leading end of the recording medium, kept attracted into the suction holes 124, is transported. Therefore, it is possible to prevent the recording medium from being stained by the contact with the recording head 231 caused by coming-up of the leading end of the recording medium.

As described above, since the leading end of the recording medium, kept attracted into the suction holes 124, is transported, it is possible to bring the recording head 231 nearer to the recording medium, and recording accuracy can be further improved. In the second embodiment, though the suction chamber 123 is formed into the rectangular recess that is long in the transporting direction of the recording medium, also in case that it is formed in the shape of grid like the related art, the similar effect can be obtained. Further, also in case that the suction unit which has only the suction hole 124 without having the suction chamber 123 is used, the similar effect can be obtained.

Next, a third embodiment of the suction part 120 will be described.

Figure 10A:
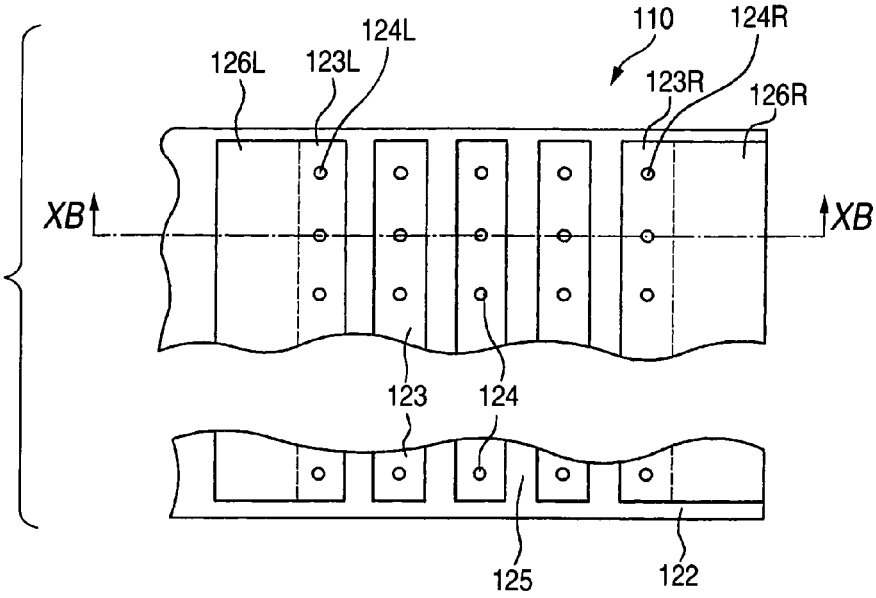
FIGS. 10A and 10B are a plan view and a sectional side view taken along a line XB-XB of FIG. 10A, which show a third embodiment of the suction part in FIG. 1.
Figure 10B:
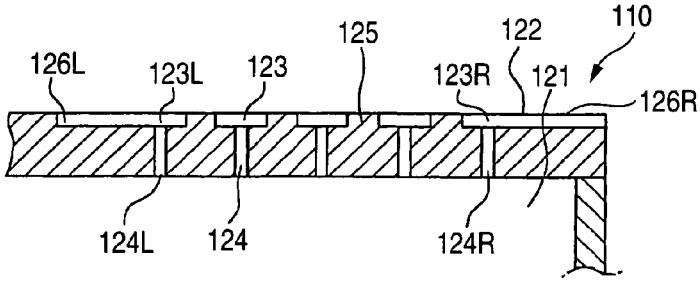

FIGS. 10A and 10B are a plan view and a sectional side view taken along a line XB-XB of FIG. 10A, which show the third embodiment of the suction part 120. The same components as those in the first embodiment are denoted by the same reference numerals.

As the characteristics of the embodiment, at portions on the medium transporting surface 122, on which the both ends of the recording medium in the direction perpendicular to the transporting direction of the recording medium, that is, the both side ends of the medium pass, escape parts 126R and 126L are formed, from which the both side ends of the recording medium can come down and be escaped. This escape part 126R, 126L, so that the both side ends of the recording medium can come down and be escaped in the escape parts, is formed lower than the recording medium transporting surface 122. For example, it may be formed into a stepwise surface.

In the example shown in FIG. 10, the stepwise escape parts 126R and 126L are formed. A partition wall 125 arranged on the right side of the right-end suction chamber 123R corresponding to the right end of the recording medium is removed, and only the recess of the suction chamber 123R is intactly extended up to the right end of the recording medium transporting surface 122 thereby to form the escape part 126R. Further, a partition wall 125 arranged on the left side of the left-end suction chamber 123L corresponding to the left end of the recording medium is removed, and only the recess of the suction chamber 123L is intactly extended up to the suction chamber 123 which was located in the left neighborhood of that removed partition wall 125 thereby to form the escape part 126L.

Here, since the both side ends of the recording medium come down in the escape parts 126R and 126L, only the part of the escape parts 126R and 126L is covered with the recording medium. Therefore, there is fear of badness of absorption-transportation of the recording medium due to lowering of the suction force. However, on the lower surfaces of the both side ends of the recording medium, negative pressure is produced by dynamic pressure loss caused by air flow between the lower surfaces of the both side ends of the recording medium and the bottom surfaces of the suction chambers 123R, 123L due to the suction holes 124R and 124L in the suction chambers 123R and 123L corresponding to the both side ends of the recording medium and by dynamic pressure loss of the suction holes 124R and 124L themselves. Therefore, it is possible to suck the both side ends of the recording medium stably and transport the recording medium.

Figure 11A:
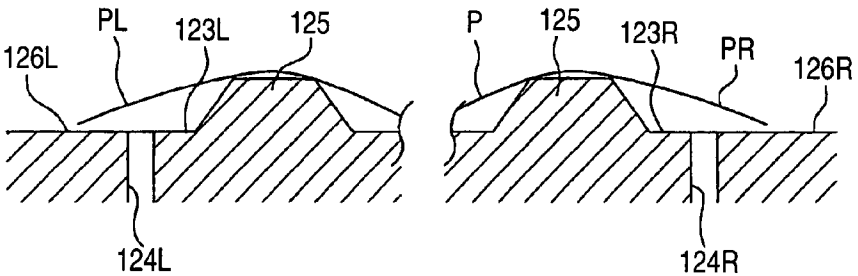
FIGS. 11A to 11C are sectional views showing examples of an escape part of FIG. 10.

Hereby, as shown in FIG. 11A, the both side ends PR and PL of the recording medium P, after come down, are transported in that state. Therefore, unlike the related art, the both side ends PR and PL do not get on the partition walls formed outside the dimples (suction chambers) corresponding to the both side ends, and it is prevented that the both side ends PR and PL curl up by the suction force of the holes (suction holes) in the dimples corresponding to the both side ends of the recording medium, so that the stain on the recording medium due to the contact with the recording head 231 can be prevented.

Figure 11B:
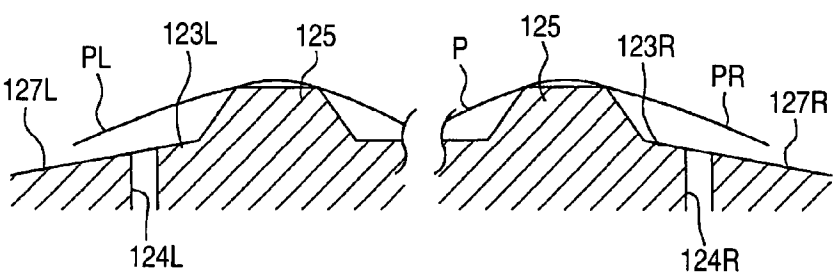
Figure 11C:
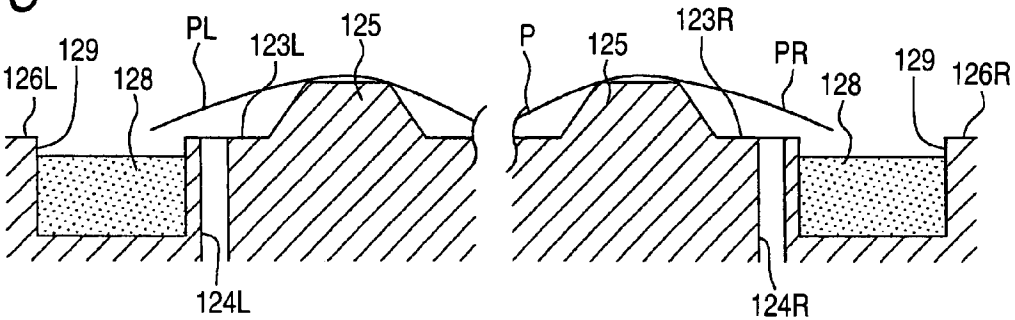

Further, as the example of the escape part 126R, 126L, the stepwise surface is taken. As long as the escape part is formed lower than the recording medium transporting surface 122 so that the both side ends of the recording medium can come down and be escaped, it may be formed into any shape, for example, a slant surface. FIG. 11B shows escape part 127R, 127L of the slant surface, in which the partition wall 125 arranged on the right side of the right-end suction chamber 123R corresponding to the right end of the recording medium is removed, and the bottom surface of the suction chamber 123R is inclined and intactly extended up to the right end of the recording medium transporting surface 122 thereby to form the escape part 127R. Further, the partition wall 125 arranged on the left side of the left-end suction chamber 123L corresponding to the left end of the recording medium is removed, and the bottom surface of the suction chamber 123L is inclined and intactly extended up to the suction chamber 123 which was located in the left neighborhood of that removed partition wall 125 thereby to form the escape part 127L.

Also in this case, since the both side ends of the recording medium come down in the escape parts 127R and 127L, only the part of the escape parts 127R and 127L is covered with the recording medium. Therefore, there is fear of badness of absorption-transportation of the recording medium due to lowering of the suction force. However, on the lower surfaces of the both side ends of the recording medium, negative pressure is produced by dynamic pressure loss caused by air flow between the lower surfaces of the both side ends of the recording medium and the bottom surfaces of the suction chambers 123R, 123L due to the suction holes 124R and 124L in the suction chambers 123R and 123L corresponding to the both side ends of the recording medium and by dynamic pressure loss of the suction holes 124R and 124L themselves. Therefore, it is possible to suck the both side ends of the recording medium stably and transport the recording medium. Further, the distance between the slant escape parts 127R, 127L and the both side ends of the recording medium becomes larger than the distance between the stepwise escape parts and the both side ends of the recording medium. Therefore, also in case that the both side ends of the recording medium come down greatly, the contact with the recording head can be prevented. In result, the both side ends of the recording medium can be more stably sucked and transported.

Hereby, as shown in FIG. 11B, the both side ends PR and PL of the recording medium P, after come down, are transported in that state. Therefore, unlike the related art, the both side ends PR and PL do not get on the partition walls formed outside the dimples (suction chambers) corresponding to the both side ends, and it is prevented that the both side ends PR and PL curl up by the suction force of the holes (suction holes) in the dimples corresponding to the both side ends of the recording medium, so that the stain on the recording medium due to the contact with the recording head 231 can be further prevented. Further, as shown in FIG. 1C, an ink receiving part in which an ink absorber 128 such as a sponge which receives and absorbs the ejected ink droplets is embedded may be arranged at the portion of the escape part 126R, 126L. Hereby, so-called frameless recording which makes possible recording on the whole surface of the recording medium can be performed.

As described above, the suction opening is composed of the suction hole 124 and the suction chamber 123, and further the suction hole 124 is formed into the through-hole having the small diameter, whereby coefficient of utilization of the negative pressure which can be utilized in relation to the characteristic of the pump 132 is heightened. Further, the suction chamber 123 is formed as the nearly rectangular recess that is larger in area than the suction hole 124, whereby the great suction force can be generated in relation to the recording medium. Further, since the partition walls 125 arranged outside the suction chambers 123R and 123L corresponding to the both side ends of the recording medium are removed thereby to form the escape parts 126R, 126L, 127R and 127L, the both side ends of the recording medium, after come down in the suction chambers 123R and 123L, are transported in that state. Therefore, unlike the related art, the both side ends of the recording medium do not curl up, so that the stain on the recording medium due to the contact with the recording head 231 can be prevented.

At this time, the both side ends of the recording medium, after come down in the suction chambers 123R and 123L, are transported in that state. Therefore, it is possible to prevent the recording medium from being stained by the contact with the recording head 231 caused by curling-up of the both side ends of the recording medium.

Figure 12:
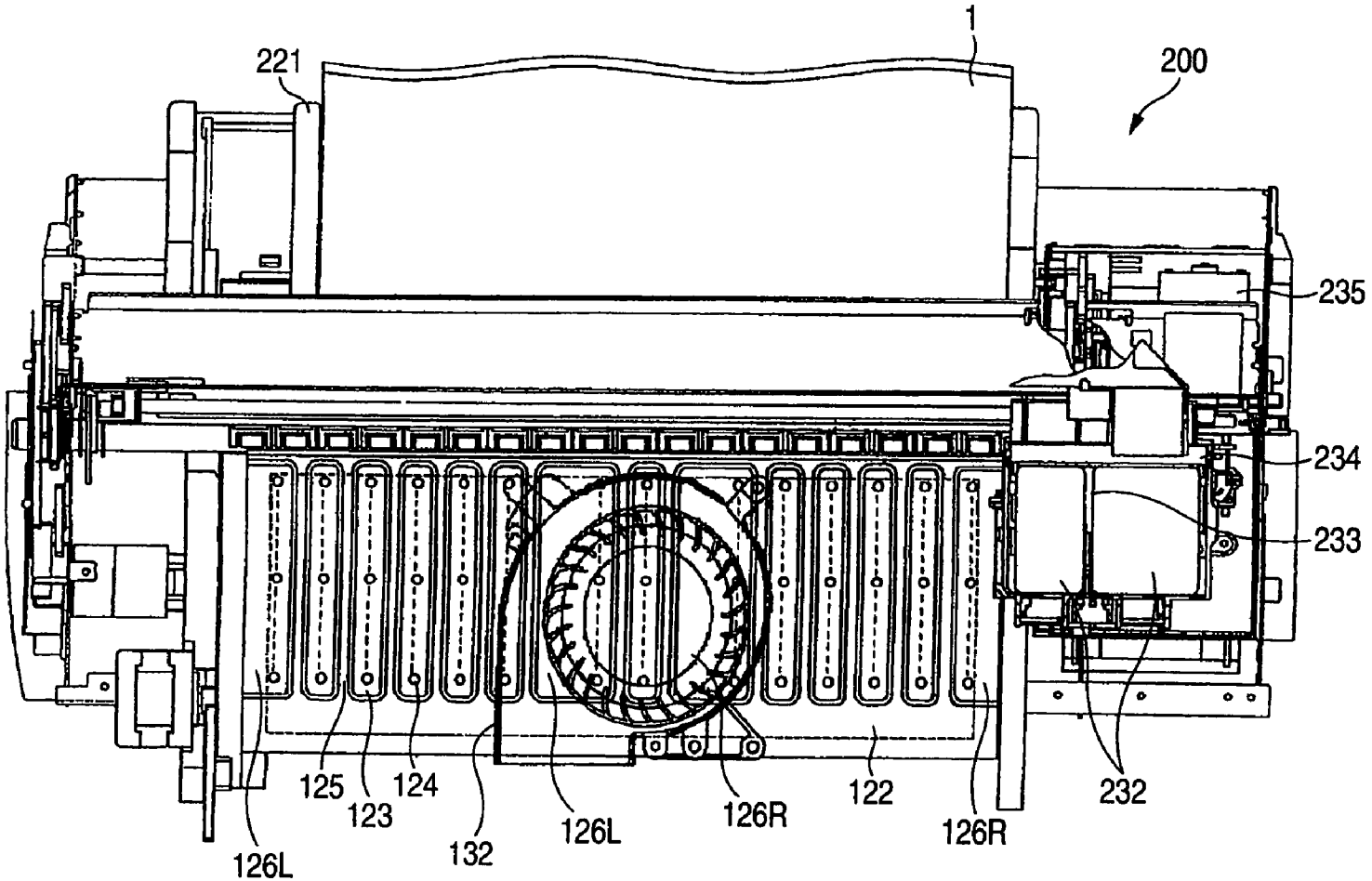
FIG. 12 is a plan view showing a main part according to the third embodiment of the ink jet printer in FIG. 4.

FIG. 12 is a plan view showing a main portion of an ink jet printer having the suction part 120 of the third embodiment, in which the same components as those in FIG. 5 are denoted by the same reference numerals. At portions of the medium transporting surface, on which the both ends of the recording medium in the direction perpendicular to the transporting direction of the recording medium, that is, the both side ends of the recording medium pass, the escape parts 126R and 126L that are stepwise surface are formed, from which the both side ends of the recording medium can come down and be escaped. These escape parts 126R and 126L are formed according to each of the recording medium, for example B5 size, A4 size, and B4 size by JIS, and the number of them are plural. Hereby, the stain on the recording medium of each size by the contact with the recording head 231 can be prevented. The both side end of the recording medium, after come down in the suction chambers 123R and 123L, are transported in that state. Therefore, it is possible to prevent the recording medium from being stained by the contact with the recording head 231 caused by curling-up of the both side ends of the recording medium.

As described above, the both side ends of the recording medium, after come down, are transported in that state. Therefore, unlike the related art, the both side ends of the medium do not get on the partition walls formed outside the dimples (suction chambers) corresponding to the both side ends of the recording medium, and it is prevented that the both side ends curl up by the suction force of the holes (suction holes) in the dimples corresponding to the both side ends of the recording medium, so that it is possible to bring the recording head 231 nearer to the recording medium, and recording accuracy can be further improved.

In the third embodiment, though the suction chamber 123 is formed into the rectangular recess that is long in the transporting direction of the recording medium, also in case that it is formed in the shape of grid like the related art, the similar effect can be obtained. Further, also in case that a suction unit which has only the suction hole 124 without having the suction chamber 123 is used, the similar effect can be obtained. Further, in the above embodiment, the invention is applied to the recording apparatus having the recording medium transporting device. However, also in case that the invention is applied to a liquid jet apparatus having a jetted material transporting device, including, for example, an ink jet printer, the similar effect can be obtained.

What is claimed is:

1. A medium transporting device comprising:

a fixed medium transporting surface on which a supplied medium is transported, including a plurality of suction chambers in each of which a plurality of suction holes are formed, and each suction chamber extending in a liquid jetting area and a downstream side of the liquid jetting area, wherein end suction chambers among the suction chambers on said medium transporting surface are provided so that both side edges, extending in a transporting direction, of said medium come downwards, wherein the end suction chambers are disposed at positions corresponding to both side ends of said medium which are transported on said medium transporting surface, and wherein said end suction chambers on said medium transporting surface are formed aslant.

2. The medium transporting device according to claim 1, wherein each of the end suction chambers is defined by a plurality of surfaces, and wherein at least one of the surfaces on which the suction holes are not formed is formed aslant.

3. A medium transporting device comprising:

a fixed medium transporting surface on which a supplied medium is transported, including a plurality of suction chambers in each of which a plurality of suction holes are formed, and each suction chamber extending in a liquid jetting area and a downstream side of the liquid jetting area, wherein end suction chambers among the suction chambers on said medium transporting surface are provided so that both side edges, extending in a transporting direction of said medium, come downwards, wherein the end suction chambers are disposed at positions corresponding to the side ends of said medium which are transported on said medium transporting surface, and wherein the end suction chambers are formed larger in a width direction of the medium than a suction chamber formed between the end suction chambers.

* * * * *